US010148008B2

(12) United States Patent
van de Water

(10) Patent No.: US 10,148,008 B2
(45) Date of Patent: Dec. 4, 2018

(54) STEERABLE ANTENNA SYSTEM AND METHOD

(71) Applicant: Proxim Wireless Corporation, Fremont, CA (US)

(72) Inventor: Cor van de Water, Fremont, CA (US)

(73) Assignee: Proxim Wireless Corporation, Fremont, CA (US)

( * ) Notice: Subject to any disclaimer, the term of this patent is extended or adjusted under 35 U.S.C. 154(b) by 186 days.

(21) Appl. No.: 14/964,932

(22) Filed: Dec. 10, 2015

(65) Prior Publication Data

US 2017/0170559 A1 Jun. 15, 2017

(51) Int. Cl.
*H01Q 3/36* (2006.01)
*H01Q 3/38* (2006.01)
*H01Q 25/00* (2006.01)

(52) U.S. Cl.
CPC ..... *H01Q 3/36* (2013.01); *H01Q 3/38* (2013.01); *H01Q 25/00* (2013.01)

(58) Field of Classification Search
CPC ..... H01Q 25/00; H01Q 3/36; H01Q 3/38
See application file for complete search history.

(56) References Cited

U.S. PATENT DOCUMENTS 5,680,141 A * 10/1997 Didomenico ..... H01Q 3/267 342/157
6,188,373 B1 * 2/2001 Martek ..... H01Q 1/246 342/375
2005/0012665 A1 * 1/2005 Runyon ..... H01Q 1/246 342/372
2009/0167605 A1 * 7/2009 Haskell ..... H01Q 3/36 342/372

* cited by examiner

*Primary Examiner* — Jessica Han
*Assistant Examiner* — Michael Bouizza
(74) *Attorney, Agent, or Firm* — Kilpatrick Townsend & Stockton LLP

(57) ABSTRACT

An antenna array device is steered laterally (horizontally) by phase shifting the RF signal at each column of the array. The phase shifting is incremented column by column. Control signals provided to the phase shifters control the steering. The antenna array device may be an MIMO antenna, with at least two arrays. Two different DC control signals may be combined with two RF signals, with the different DC control signals used to control a left or right side of each of the two antenna arrays.

14 Claims, 5 Drawing Sheets

STEERABLE ANTENNA SYSTEM AND METHOD

BACKGROUND OF THE INVENTION

Antennas are used in data networks for wirelessly transmitting data between locations. For example, data collected from a number of users may be aggregated at a location for transmission over the backbone of the Internet to various servers. Rather than a wired or fiber optic transmission, antennas may be used with radio transceivers for transmitting data from one point to another in the network.

For optimal wireless transmission of data, it is often desirable to have steerable antennas that can more effectively direct radio signals from one point to another. Some antennas are designed to be manually adjusted for optimal alignment and transmission. However, such an arrangement may not work well in some locations where the antenna may not be easily accessed for physical adjustment. Further, numerous adjustments across multiple antennas may be required for optimal alignment among those antennas, which may add significant labor costs in manually adjusting the antennas.

While electronically steerable antennas are known, they tend to be expensive. Electronically steerable antennas often involve a complex arrangement of phase shifters that are associated with an array of antenna elements. The RF signal provided to each antenna element is phase shifted by a predetermined amount, so that in conjunction with phase shifting done at other antenna elements, the transmitted RF signal (a combination of individual phased shifted RF signal components transmitted by all of the elements in the array) is electronically steered in a desired direction. The number of phase shifters and complexity of controlling them to obtain the desired steering drives up the cost of the antenna, and for this reason steerable antenna arrays are typically only used in commercial and military installations having sophisticated and expensive antenna systems.

BRIEF SUMMARY OF THE INVENTION

There is provided, in accordance with embodiments of the present invention, a system and method for steering an antenna system having an array of antenna elements. The antenna elements are arranged in columns (substantially parallel lines), with the antenna elements in each column phase shifted by the same amount.

In one embodiment, a system includes an array of antenna elements, the array of antenna elements arranged in a plurality of substantially parallel lines, with the antenna elements each transmitting/receiving an RF signal. The system further includes a plurality of phase shifter circuits, each for receiving the RF signal. Each of the plurality of phase shifter circuits is connected to all the antenna elements in one line of the array of antenna elements, so that the RF signal at each line of antenna elements is phase shifted by the same amount to steer the antenna in a direction substantially lateral to the substantially parallel lines of antenna elements.

A more complete understanding of the present invention may be derived by referring to the detailed description of the invention and to the claims, when considered in connection with the Figures.

DETAILED DESCRIPTION OF THE INVENTION

Figure 1:
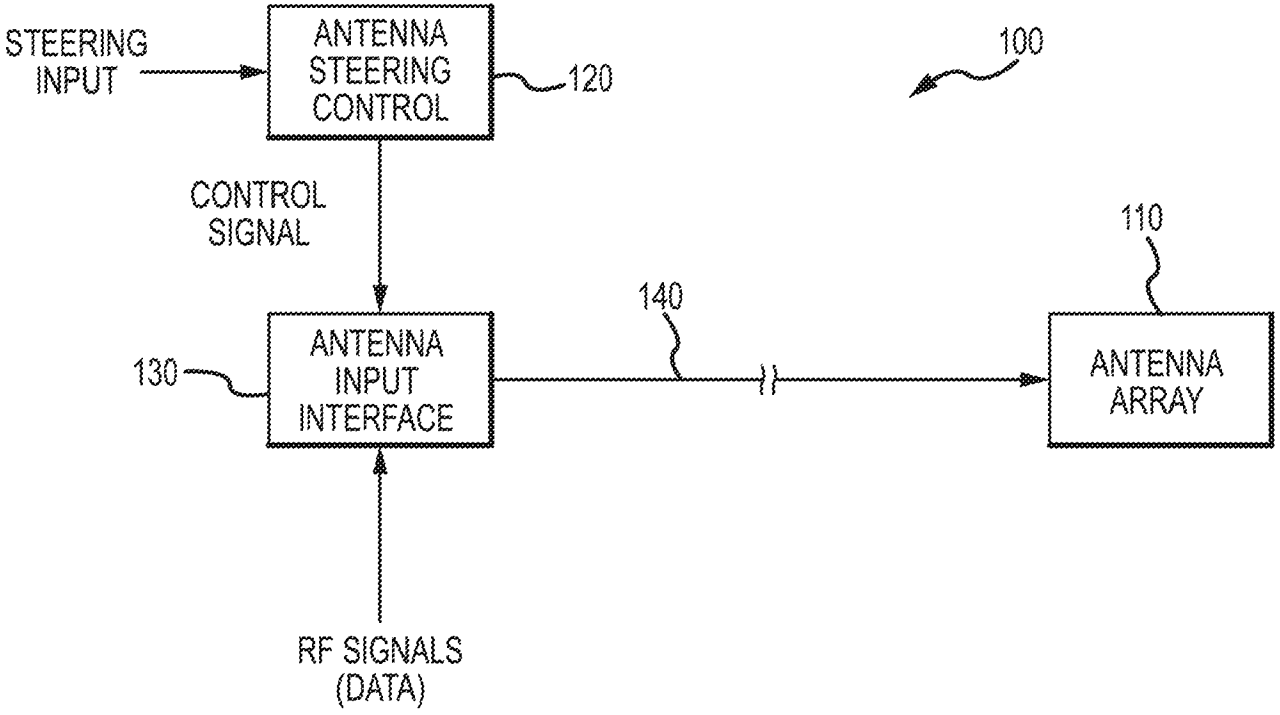
FIG. 1 is a simplified block diagram of a steerable antenna system in accordance with one embodiment of the invention.

There are various embodiments and configurations for implementing the present invention. One such implementation is generally illustrated in FIG. 1, and includes an antenna system 100 having an antenna array device 110. The antenna array device 110 transmits RF signals (e.g., the RF signals are transmitted simultaneously from a plurality of radiating antenna elements, typically arranged in an array of equally spaced rows and columns at the antenna device). The antenna system 100 also includes an antenna steering control system 120 which receives input from a user for purposes of steering the antenna array 110, or in some embodiments, input from a system (not shown) for automatic steering of the antenna array, e.g., in response to RF transmission signal monitoring, to interference with RF signals reported by other antenna systems, or to changes in the operational conditions or the radio environment in which the antenna array 110 operates. In response to the steering input, the antenna steering control system 120 provides a control signal (e.g., one or more DC signals) to the antenna array device 110 by way of an antenna input interface 130. The antenna input interface 130 also receives RF signals (e.g., from a RF transceiver, not shown) that represent data and to be transmitted by the antenna array 110. The RF signals and control signal are provided by the antenna input interface 130 over a transmission line 140 to the antenna array. In described embodiments, the transmission line may include one or more coaxial cables, with the RF signal and control signal combined at the antenna input interface, provided over the line 140 to the antenna array, and then split back into separate RF and control signals at the antenna array device. The resulting control signal at the antenna array device is provided to phase shifters for purposes of electronically steering the antenna and the resulting RF signal at the antenna array device is transmitted by the individual antenna elements within the antenna array.

In one embodiment, the antenna steering control system 120 and the antenna input interface are at one location (e.g., where the antenna steering control system is available to a user/operator who may want to steer the antenna array device 110), and the antenna array device 110 is located at a different, more remote location that has been chosen for optimal transmission of RF signals (e.g., at the top of a building, tower or utility pole).

As will be more fully described below, in described embodiments each column of antenna elements in the antenna array has RF signals all phase shifted together by a same, predetermined amount during transmission or receipt of the RF signals by the individual antenna elements. The amount or degree of phase shifting is incremented from column to column, resulting in electronic steering the antenna in a lateral direction (e.g., with the columns of antenna elements aligned vertically and with incremental phase shifting at each column, the overall RF signal transmitted/received at the antenna array device would be steered in horizontal direction).

In one embodiment, as will also be more fully described below, the antenna array device 110 is an MIMO (multiple input multiple output) antenna device having at least two arrays of antenna elements, each array for transmitting a separate stream of RF signals. Such an arrangement provides advantages by having two control signals (when two arrays are present at the antenna array device 110), and using the two control signals to separately control two sections of each of the two antenna arrays. In such an arrangement, the transmission line 140 includes two coaxial cables, with each cable carrying a different combined RF signal and control signal. When combined signals are separated at the antenna array device 110, the two control signals are used by both antenna arrays to separately control the two sections of each of the two antenna arrays.

Figure 2:
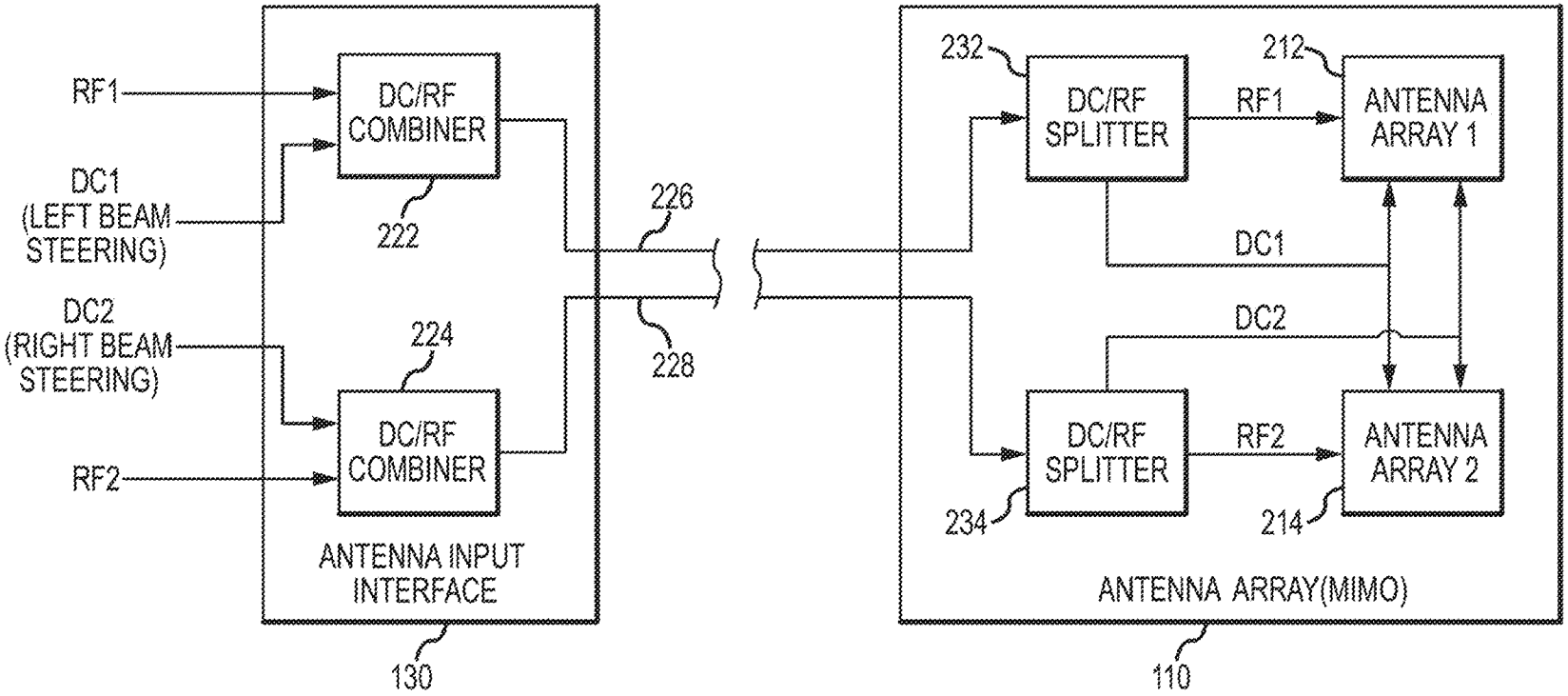
FIG. 2 is a block diagram illustrating further details of the antenna input interface and antenna array device seen in of FIG. 1

FIG. 2 illustrates in greater detail the antenna array device 110 and the antenna input interface 130. As mentioned earlier, the antenna array device 110 may be an MIMO antenna, and thus consists of more than one array of antenna elements. In the described embodiment, there are two antenna arrays 212 and 214 (Antenna Array 1 and Antenna Array 2), but it should be appreciated that the number of antenna arrays depends on various needs of the operator of the system, such as the expected volume of wireless data that needs to be transmitted or the desired error rate of the transmission.

Further, as will be discussed later with reference to various components in FIG. 2, the configuration seen in FIG. 2 (and its corresponding description) is directed to steering the antenna arrays 212 and 214 when they are transmitting radio signals. However, as will be understood by those skilled in the art, the same circuitry may also be used for steering antenna arrays 212 and 214 when they are receiving radio signals.

As seen in FIG. 2, two RF signals (RF 1 and RF 2) are to be transmitted (i.e., each is transmitted separately by one of the two arrays in the antenna array device 110). Also, two control signals (DC1 and DC2) are provided by the steering control system 120. In the described embodiment, one DC control signal (DC1) is responsible for steering one side (left side) of each of the two antenna arrays and the other DC control signal (DC2) is responsible for steering the other side (right side) of the two antenna arrays. While the control signals DC1 and DC2 in the embodiment illustrated FIG. 2 are each DC signals generated by analog circuitry within the steering control system, it should be understood that in alternative embodiments, the control signals may be digital signals.

The antenna input interface 130 includes two DC/RF combiner circuits 222 and 224. Combiner circuit 222 superimposes signal DC1 onto signal RF 1, and combiner circuit 224 superimposes signal DC2 onto signal RF 2. The combiner circuits 222 and 224 provide their combined signals, by way of bi-directional coaxial transmission lines 226 and 228, to the antenna array device 110. In the described embodiment, the combiner circuits 222 and 224 may each be implemented with a conventional bidirectional RF power splitter/combiner circuit, having a high pass filter (for passing the RF signals) and a low pass filter (for passing the low frequency analog or digital control signals), and having two inputs (one for the RF signals and the other for the control signals) and a single output (the RF and control signals pass through the high and low pass filters and are combined at the output).

The antenna array device 110 includes two DC/RF splitter circuits 232 and 234 that split the combined signals received from lines 226 and 228 into separate RF and DC signals. Splitter circuit 232 provides its RF output (signal RF1) to one antenna array 212 (Antenna Array 1) and splitter circuit 234 provides it out its RF output (signal RF2) to a second antenna array 214 (Antenna Array 2). In the described embodiment, the splitter circuits 232 and 234 may be conventional RF power splitter/combiner circuits, similar to the combiner circuit 212 and 214, but with inputs and outputs reversed (combined RF/control signals received at the input and passed through the high and low pass filters to provide separate RF and control signals at the two outputs).

The described combiner and splitter circuits are exemplary only, and other forms of combiner circuits and splitter circuits may be used.

As will be described shortly, in the embodiment of FIG. 2, each antenna array uses both DC control signals, one control signal one for controlling one section or side of each antenna array and the other DC control signal for controlling the other section or side of each antenna array. For convenience in the illustrated embodiment, the two sides of the antenna arrays are referred to as the left side of the antenna array and the right side of the antenna array. Thus, in the MIMO antenna array 110 seen in FIG. 2, the two control signals DC1 and DC2 (provided by splitter circuits 232 and 234) are provided to both arrays 212 and 214, with control signal DC1 controlling the left side of each array and control signal DC2 controlling the right side of each array. The particular manner in which the steering is accomplished with two control signals will be described below. However, it should be understood that in other embodiments, there may be different numbers of control signals (less than two or more than two). As an example only, three control signals could be used when each antenna array has three sections. Also, a single control signal could be used (e.g., a second control signal could be derived from that single control signal).

Further, while the described embodiment shows only two antenna arrays 212 and 214, in alternative embodiments there could be more than two antenna arrays in a MIMO antenna device. In such alternative embodiments there would typically be two sides (a left side and a right side) at each antenna array, and thus only the need for two control signals for each array. For example, if there were three antenna arrays within the antenna array device 110, there would be three transmission lines connecting the antenna input interface 130 to the antenna array 110, with two of those lines carrying a combined DC/RF signal (the RF signals for two of the three arrays and the two DC control signals controlling all three antenna arrays), and with the third line carrying only an RF signal (for the third antenna array).

Further, while described embodiments provide for the RF signals and DC control signals to be combined at antenna input interface 130 and then provided over coaxial cable lines (e.g., transmission lines 226 and 228) to the antenna array device 110, in some embodiments the RF signals and DC control signals might not be combined, but rather carried over separate transmission lines to the antenna array device 110.

Figure 3:
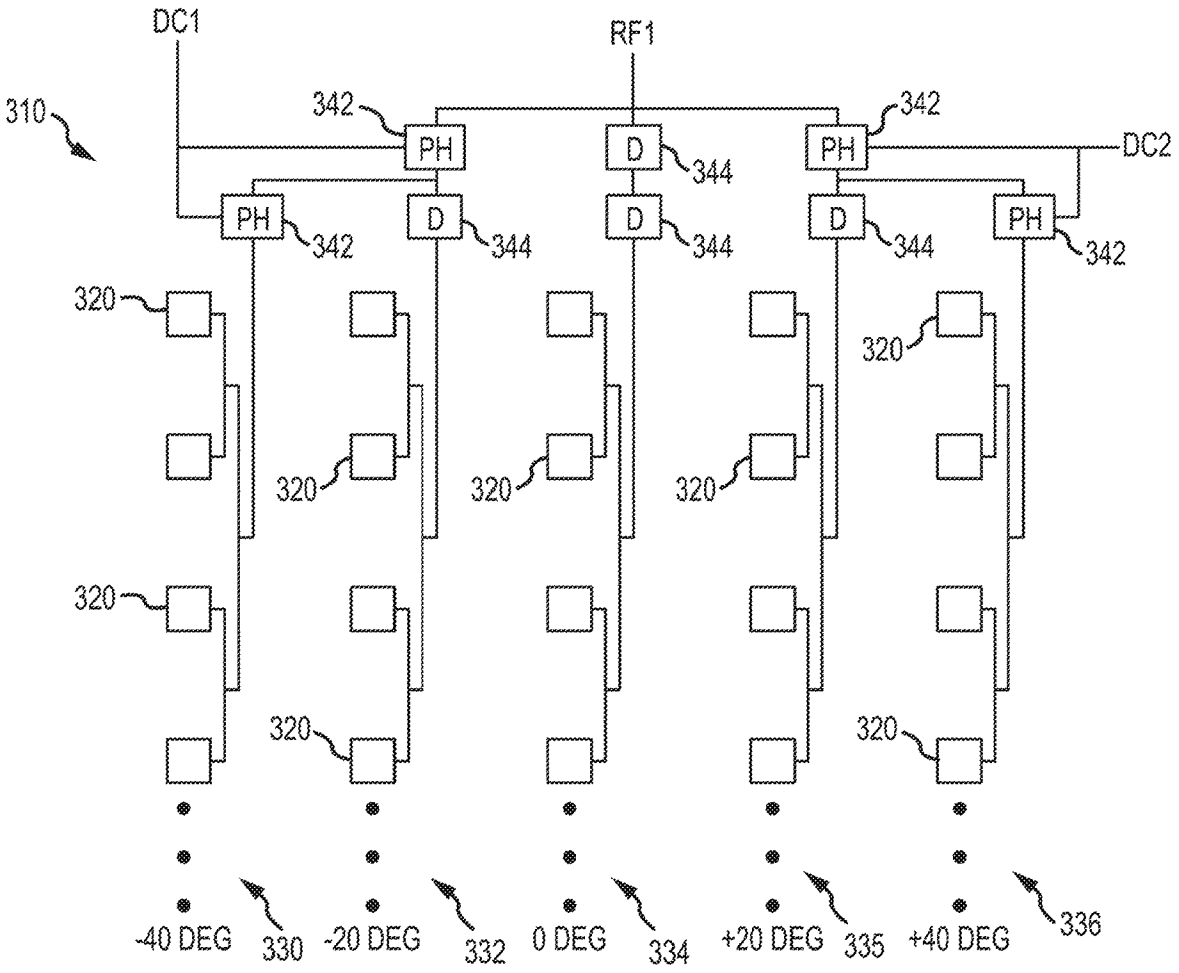
FIG. 3 is a more detailed diagram of components at one of the antenna arrays seen in FIG. 2.

Turning now to FIG. 3, there is illustrated in greater detail an exemplary embodiment of an antenna array 310 that may represent one of the antenna arrays 212 and 214 seen in FIG. 2. For purposes of the present description, it is assumed that array 310 represents antenna array 212 and thus receives RF signal RF1 (from splitter circuit 232), with that RF signal transmitted by each of a plurality of radiating antenna elements 320 that are arranged in columns (e.g., substantially parallel vertical lines). It will be appreciated that, while the columns of antenna elements 320 are illustrated as vertical (so that phase shifting, when implemented, results in the horizontal steering), the general orientation of the columns could alternatively be horizontal (for vertical steering) or any other orientation between horizontal and vertical (as long as the columns/lines are substantially parallel), with the direction of steering being generally lateral or perpendicular to the columns of antenna elements.

FIG. 3 illustrates the array 310 having five columns 330-336, with a plurality of radiating antenna elements 320 in each column. Only four radiating elements are illustrated in each column in FIG. 3, but it should be appreciated that typically there could be more or less than four antenna elements in each column, and that there could be more or less than five columns of antenna elements in the antenna array. The antenna array 310 also receives two control signals (DC1 and DC2). For reasons that will be described in more detail shortly, the control signal DC1 is provided to the left side of the antenna array 310 (columns 330 and 332) and the control signal DC2 is provided to the right side of the antenna array 310 (columns 335 and 336). There is no control signal provided to the center column, column 334 in this embodiment.

The antenna array 310 includes a plurality of phase shifter circuits 342 and fixed delay circuits 344. The purpose of the phase shifter circuits 342 is to phase shift signal RF 1 in each of the columns of antenna elements (other than column 334). In the arrangement seen, there is one phase shifter circuit 342 through which RF signals pass in columns 332 and 335 and two phase shifter circuits 342 through which RF signals pass in columns 330 and 336. In the embodiment illustrated, the phase shifter circuits 342 at columns 330 and 332 each shift the RF signal by 20° in response to an incremental change in the control signal. As a simplified example only, if the circuitry were designed for the voltage levels of DC1 and DC2 to change in 2V increments between approximately 0V and 20V (where approximately 10V represents a center or neutral steering position for the antenna), a change in voltage from 10V to 12V at DC1 results in a −20° incremental phase shift of the RF signal and a change from 10V to 8V at DC2 results in a +20° incremental phase shift of the RF signal. Thus, column 332, having the RF signal passed through a single phase shifter, shifts the RF signal by −20°. Column 330, having the RF signal passed through two phase shifters, shifts the RF signal by −40°. Column 335, having the RF signal passed through a single phase shifter, shifts the RF signal by +20°. Column 336, having the RF signal passed through 2 phase shifters, shifts the RF signal by +40°. Column 334 is a neutral column, having no phase shifters, and thus there is no shifting of the RF signal at column 334. The illustrated phase shift of the RF signals across the columns of antenna elements results in the antenna laterally steering the RF signals.

The fixed delay circuits 344 are placed in various columns to make sure that the RF signal received at each column of antenna elements is appropriately delayed to compensate for inherent delays in the phase shift circuits. Thus, column 334 has two delay circuits, columns 332 and 335 have one delay circuit, and columns 330 and 336 have no delay circuits. Thus the RF signal is received at all of the columns with the same amount of the delay, as determined by the inherent delay in the phase shifter circuits 342 and the delay provided by the delay circuits 344.

In the illustrated embodiment, the phase shifter circuits 342 provide a degree phase shift based on the value of the control signal provided. The phase shifter circuits 342 on the left side of the antenna array 310 each provide −20° of phase shift in response to the control signal DC1. Phase shifters 342 the right side of the antenna array 310 each provide +20° of phase shift in response to the control signal DC2. It is assumed for purposes of the present description that control signals DC1 and DC2 have voltage levels with an inverse relation to each other, with one being a smaller voltage and the other being at a higher voltage level. Thus, the phase shifters at columns 330 and 332 provide a negative phase shift and the phase shifters at columns 335 and 336 provide a positive phase shift. As the value of control signals DC1 and DC2 are increased or decreased, the amount of phase shifting may correspondingly increase or decrease.

As mentioned earlier, with phase shifting of the same RF signal, and with the degree of phase shifting incremented from column to column, the combined or cumulative RF signal generated by all of the antenna elements together result in a lateral or horizontal steering of the RF signal. With the amount of incremental phase shifting illustrated in FIG. 3 (+20° per column from left to right), the antenna is shifted in one direction (e.g., to the left). If the incremental phase shifting were reversed (−20° per column from left to right), the antenna would be shifted in the opposite direction. The amount of steering (i.e., how much the RF signal will be shifted in one direction or the other) will be determined by the degree of phase shifting at each column, e.g., phase shifting of more than 20° per column will result in more steering in one direction or the other.

As should be apparent, if none of the phase shifters receive a change in the control signal voltage level (from a neutral position voltage level), there is no phase shift (and all signals are delivered to the antennal elements with the same amount of delay), and the antenna maintains a neutral steering position.

The phase shifter circuits 342 may each be a conventional phase shifter circuit. In one embodiment, the phase shifters may be digitally controlled phase shifters. In another embodiment, the phase shifters may be a continuous variable phase shifter, containing a device such as a varactor, having a voltage-dependent capacitance circuit. Such a variable phase shifter requires an analog signal input and advantageously provides a variable phase-shifted output for more granularity (smaller or finer adjustment) in the antenna steering (steering adjustment in response to a varying value of the analog input). In such embodiment, a Digital to Analog converter (not shown) could be used at the antenna array to convert digital signals from the antenna steering control system 120 to analog signals provided to the phase shifter. Alternatively, the control signals provided at the output of the antenna steering control system 120 could be analog signals.

The delay circuits 344 may be a conventional delay circuit, such as a delaying transmission line segment (the delay determined by the length of the line segment).

Figure 4:
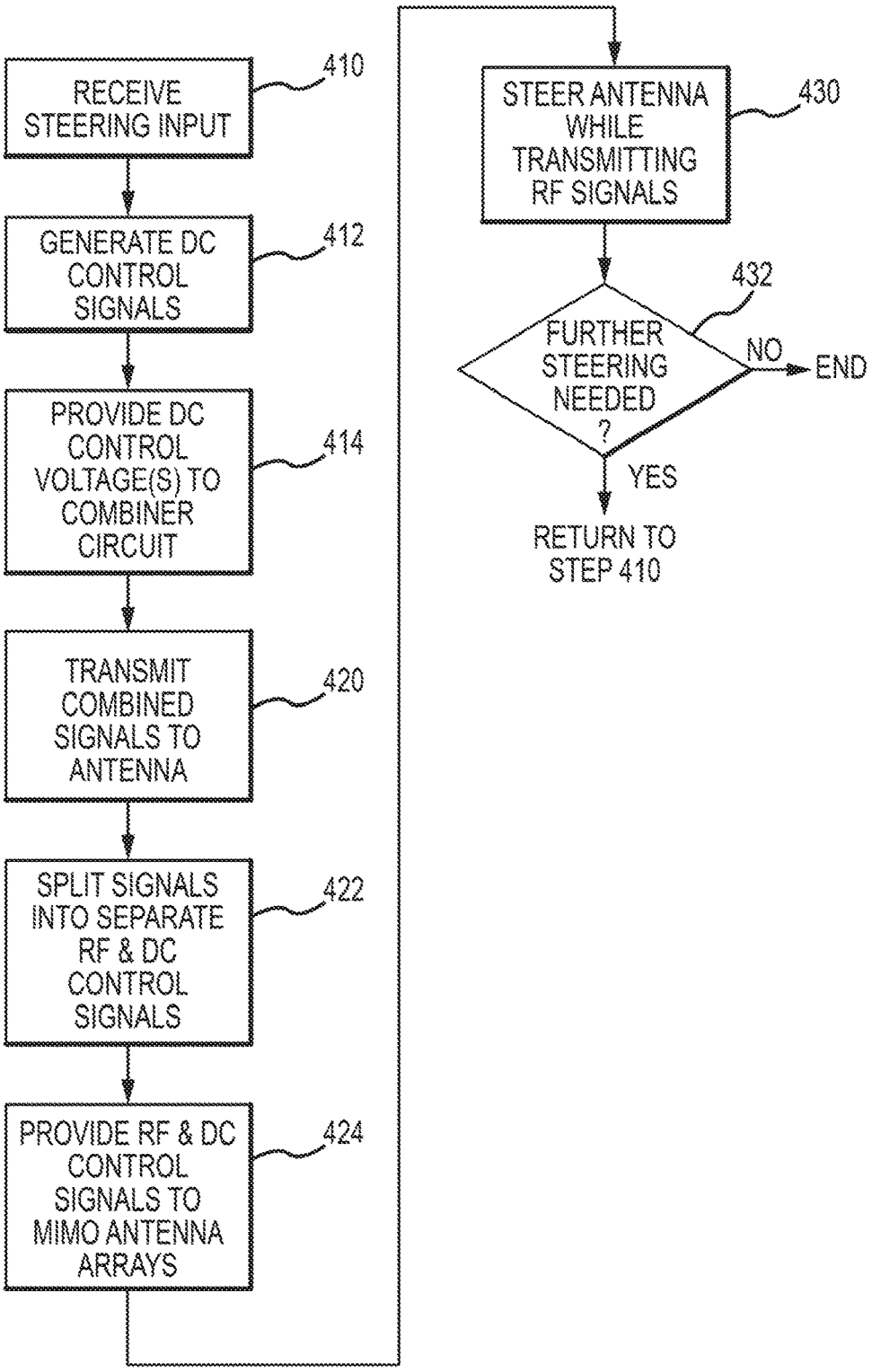
FIG. 4 is a flow diagram illustrating the operation of the antenna system shown in FIG. 1.

FIG. 4 is a flow diagram illustrating the operation of the antenna system 100 seen in FIG. 1, including various exemplary components thereof seen in FIGS. 2 and 3, as controlled by the antenna steering control system 120. At step 410, the antenna steering control system 120 receives input from a user (or from a system for automatic steering) indicating that the antenna array 110 is to be steered in one direction or the other (e.g., laterally in relation to the columns of antenna elements within the array). In response to receiving this steering input, the antenna steering control system 120 generates DC control signals (e.g., control signals DC1 and DC2), step 412. The DC control signals are provided to the combiner circuits 222 and 224 within the antenna input interface 130, step 414, where they are combined with the RF signals to be transmitted by the antenna, and the combined signals are communicated over transmission lines 226 and 228 to the antenna array device 110, step 420.

At the antenna array device 110, the combined RF signals and DC control signals are split (by splitter circuits 232 and 234), step 422, with the separated RF and DC control signals provided to the antenna arrays 212 and 214 within the antenna array device 110, step 424. As the RF signals are being transmitted by the individual antenna elements, the antenna array itself is electronically steered based on the DC control signals, step 430.

It should be appreciated that the steering of the antenna array (and its transmitted RF signals) may be done as part of an iterative process. For example, the operator or user that provides the steering input at step 410 may receive feedback as to whether the transmission of the RF signals has improved as a result of the steering at step 430. If there has been sufficient improvement to transmission and no further steering is needed, step 432, the process may end. However if the quality of the transmission is not optimal, the user may further steer the antenna array by returning to step 410 and providing further input to the antenna steering control system 120, resulting in, e.g., increased DC control signals (to further steer the antenna array) or reducing the level of the DC control signals in order to steer the antenna array in the opposite direction.

While FIGS. 2, 3 and 4 describe the antenna array being steered during RF signal transmission, those skilled in the art will appreciate that the steering can also be accomplished during RF signal receipt. In such case, the flow of RF signals are reversed from the flow seen, e.g., in FIG. 2, with combiner circuits 222 and 224 operating as splitter circuits and splitter circuits 232 and 234 operating as combiner circuits. In general, the combiner/splitter circuits combine the control and RF signals when provided to transmission lines 226, 228, and separate the combined control and RF signals when received from the transmission lines 226, 228.

Figure 5:
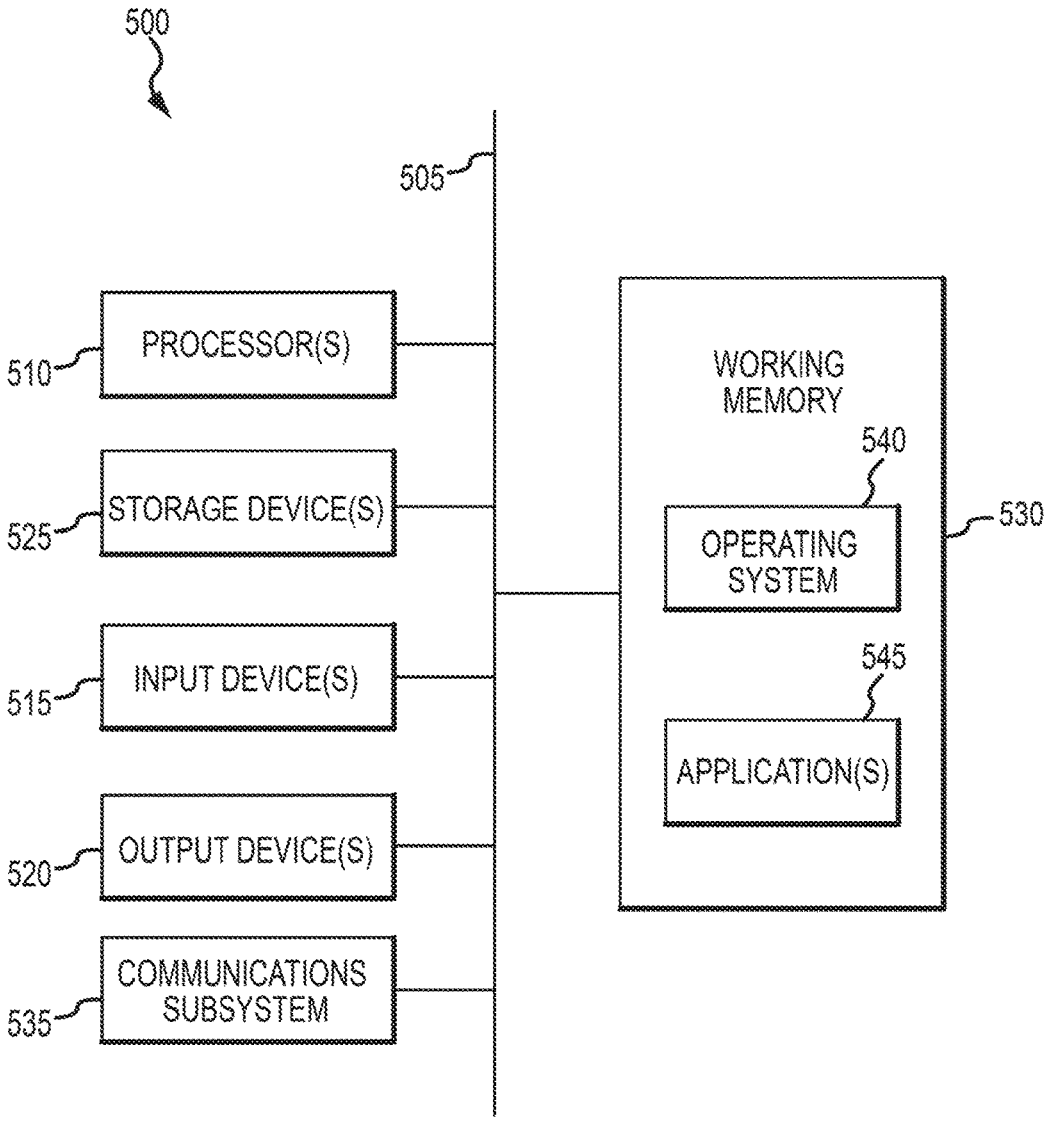
FIG. 5 is a simplified block diagram illustrating an exemplary computer system used to implement the antenna steering control system seen in FIG. 1.

FIG. 5 is a block diagram illustrating an exemplary computer system upon which embodiments of the present invention may be implemented. This example illustrates a computer system 500 such as may be used, in whole, in part, or with various modifications, to provide the functions of the antenna system 100, including the steering control system 120, as well as other components and functions of the invention described herein.

The computer system 500 is shown comprising hardware elements that can be electrically coupled or otherwise in communication via a bus 505. The hardware elements can include one or more processors 510, including, without limitation, one or more general-purpose processors and/or one or more special-purpose processors (such as digital signal processing chips, graphics acceleration chips, and/or the like); one or more input devices 515, which can include, without limitation, a mouse, a keyboard and/or the like; and one or more output devices 520, which can include, without limitation, a display device, a printer and/or the like.

The computer system 500 may further include one or more storage devices 525, which can comprise, without limitation, local and/or network accessible storage or memory systems having computer or machine readable media. Common forms of physical and/or tangible computer readable media include, as examples, a floppy disk, a flexible disk, hard disk, magnetic tape, or any other magnetic medium, an optical medium (such as CD-ROM), a random access memory (RAM), a read only memory (ROM) which can be programmable or flash-updateable or the like, and any other memory chip, cartridge, or medium from which a computer can read data, instructions and/or code. In many embodiments, the computer system 500 will further comprise a working memory 530, which could include (but is not limited to) a RAM or ROM device, as described above.

The computer system 500 also may further include a communications subsystem 535, such as (without limitation) a modem, a network card (wireless or wired), an infra-red communication device, or a wireless communication device and/or chipset, such as a Bluetooth® device, an 802.11 device, a WiFi device, a WiMax device, a near field communications (NFC) device, cellular communication facilities, etc. The communications subsystem 535 may permit data to be exchanged with a network, and/or any other devices described herein. Transmission media used by communications subsystem 535 (and the bus 505) may include copper wire, coaxial cables and fiber optics. Hence, transmission media can also take the form of waves (including, without limitation radio, acoustic and/or light waves, such as those generated during radio-wave and infra-red data communications).

The computer system 500 can also comprise software elements, illustrated within the working memory 530, including an operating system 540 and/or other code, such as one or more application programs 545, which may be designed to implement, as an example, the process seen in FIG. 4.

As an example, one or more methods discussed earlier might be implemented as code and/or instructions executable by a computer (and/or a processor within a computer). In some cases, a set of these instructions and/or code might be stored on a computer readable storage medium that is part of the system 500, such as the storage device(s) 525. In other embodiments, the storage medium might be separate from a computer system (e.g., a removable medium, such as a compact disc, etc.), and/or provided in an installation package with the instructions/code stored thereon. These instructions might take the form of code which is executable by the computer system 500 and/or might take the form of source and/or installable code, which is compiled and/or installed on the computer system 500 (e.g., using any of a variety of generally available compilers, installation programs, compression/decompression utilities, etc.). The communications subsystem 535 (and/or components thereof) generally will receive the signals (and/or the data, instructions, etc., carried by the signals), and the bus 505 then might carry those signals to the working memory 530, from which the processor(s) 510 retrieves and executes the instructions. The instructions received by the working memory 530 may optionally be stored on storage device 525 either before or after execution by the processor(s) 510.

While various methods and processes described herein may be described with respect to particular structural and/or functional components for ease of description, methods of the invention are not limited to any particular structural and/or functional architecture but instead can be implemented on any suitable hardware, firmware, and/or software configuration. Similarly, while various functionalities are ascribed to certain individual system components, unless the context dictates otherwise, this functionality can be distributed or combined among various other system components in accordance with different embodiments of the invention. As one example, the steering control system 120 may be implemented by a single system having one or more storage device and processing elements. As another example, the steering control system 120 may be implemented by plural systems, with their respective functions distributed across different systems either in one location or across a plurality of linked locations. Also, it should be appreciated that the antenna input interface 130 could either be a standalone component or be integrated within a radio transceiver used with the antenna system.

Moreover, while the various flows and processes described herein (e.g., the process illustrated in FIG. 4) are described in a particular order for ease of description, unless the context dictates otherwise, various procedures may be reordered, added, and/or omitted in accordance with various embodiments of the invention. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments may be described with (or without) certain features for ease of description and to illustrate exemplary features, the various components and/or features described herein with respect to a particular embodiment can be substituted, added, and/or subtracted to provide other embodiments, unless the context dictates otherwise. Consequently, although the invention has been described with respect to exemplary embodiments, it will be appreciated that the invention is intended to cover all modifications and equivalents within the scope of the following claims.

What is claimed is:

1. A steerable antenna system, comprising:

an array of antenna elements, the array arranged in a plurality of separate, substantially parallel and laterally spaced apart lines, with each line including a plurality of antenna elements, and with the antenna elements each transmitting/receiving an RF signal;

a plurality of phase shifter circuits, each for receiving the RF signal;

each of the plurality of phase shifter circuits connected to all the antenna elements in one line of the separate and laterally spaced apart parallel lines of the array of antenna elements, with one phase shifter circuit connected to all of the antenna elements in the one line of antenna elements, so that the RF signal at each line of antenna elements is phase shifted by the same amount to steer the antenna in a direction substantially lateral to the parallel lines of antenna elements, with the amount of phase shifting incremented line by line;

wherein the phase shifting is incremented line by line by incrementing the number of phase shifter circuits connected in each line of antenna elements;

a plurality of delay circuits at the array of antenna elements, each of the delay circuits matched with the phase shifter circuits to accommodate delay of the phase shift circuits, so that the RF signals are presented with the same delay across the lines of antenna elements;

an antenna steering control system at one location for providing at least one control signal for controlling the phase shifter circuits at the array of antenna elements, with the array at a different location remote from the one location;

a transmission line between the one location and the remote location, the transmission line connected to the array of antenna elements for carrying the RF signal to or from the array;

a combiner circuit for combining the control signal with the RF signal when providing the RF signal to the transmission line; and a splitter circuit for separating the combined control signal and RF signal when received from the transmission line.

2. The antenna system of claim 1, wherein the substantially parallel lines of antenna elements are columns of antenna elements, wherein the RF signal at each column of antenna elements is phase shifted by the same amount, with the amount of phase shifting incremented column by column to steer the antenna in a direction substantially lateral to the columns of antenna elements.

3. The antenna system of claim 1, wherein the at least one control signal is a DC control signal that incrementally changes the phase shifting in response to an incrementally changing value of the DC control signal.

4. The antenna system of claim 1, wherein the at least one control signal is an analog control signal that varies the phase shifting in response to a varying value of the analog control signal.

5. The antenna system of claim 1, wherein the antenna system comprises an MIMO antenna having two or more antenna arrays that each transmit a separate one of two or more RF signals, wherein each antenna array has two or more sections, and wherein control signals are received at the antenna system, each of the control signals for controlling one section of each of the two or more antenna arrays.

6. The antenna system of claim 5, wherein the antenna steering control system provides at least two of the control signals for controlling the phase shifter circuits, wherein each of the control signals is combined with one of the two or more RF signals, and communicated over one of two or more transmission lines to the MIMO antenna.

7. The antenna system of claim 1, wherein the parallel lines of antenna elements are equally spaced apart.

8. A steerable antenna for transmitting RF signals, comprising:

an array of antenna elements arranged in a plurality of separate columns, the columns substantially parallel and laterally spaced apart from each other, with each column including a plurality of antenna elements, and wherein antenna elements in each column are connected for transmitting an RF signal; and a plurality of voltage controlled phase shifters, with one voltage controlled phase shifter connected to all of the antenna elements in each column of antenna elements, each voltage controlled phase shifter for phase shifting the RF signal in response to receiving a DC voltage;

the plurality of phase shifter circuits connected so that the antenna elements in each column of the array of antenna elements are all transmitted with the same degree of phase shift, with a center column in the array of antenna elements having a neutral phase shifting, with each column in the array of antenna elements located in one direction from the center column phase shifting RF signals with increasing degrees of phase shift in relation to the center column, and with each column in the other direction from the center column phase shifting RF signals with decreasing degrees of phase shift in relation to the center column.

9. A method for steering an antenna system having an array of antenna elements, comprising:

arranging the array of antenna elements in a plurality of separate, substantially parallel and laterally spaced apart lines, with each line including a plurality of antenna elements, and with the antenna elements each transmitting/receiving an RF signal;

phase shifting the RF signal at each of a plurality of phase shifter circuits at the array of antenna elements;

wherein each of the plurality of phase shifter circuits are connected to all the antenna elements in one line of the separate and laterally spaced apart parallel lines of the array of antenna elements, with one phase shifter circuit connected to all of the antenna elements in the one line of antenna elements, so that the RF signal at each line of antenna elements is phase shifted by the same amount to steer the antenna in a direction substantially lateral to the substantially parallel lines of antenna elements, with the amount of phase shifting incremented line by line;

wherein the phase shifting is incremented line by line by incrementing the number of phase shifter circuits connected in each line of antenna elements.

10. The method of claim 9, wherein the substantially parallel lines of antenna elements are columns of antenna elements, wherein the RF signal at each column of antenna elements is phase shifted by the same amount, with the amount of phase shifting incremented column by column to steer the antenna in a direction substantially lateral to the columns of antenna elements.

11. The method of claim 9, further comprising:

providing, by an antenna steering control system, at least one control signal for controlling the phase shifter circuits.

12. The method of claim 11, wherein the at least one control signal is a DC control signal that incrementally changes the phase shifting in response to an incrementally changing value of the DC control signal.

13. The method of claim 11, wherein the at least one control signal is analog control signal that variably changes the phase shifting in response to a varying value of the analog control signal.

14. The method of claim 11, further comprising:

carrying the RF signal to or from the array on a transmission line;

combining, at a combiner circuit, the control signal with the RF signal when providing the RF signal to the transmission line; and separating, at a splitter circuit, the combined control signal and RF signal when received from the transmission line.

* * * * *